US012116234B2

(12) United States Patent
Oishi et al.

(10) Patent No.: US 12,116,234 B2
(45) Date of Patent: Oct. 15, 2024

(54) MEDIUM TRANSPORT DEVICE AND MEDIUM PROCESSING APPARATUS INCLUDING THE SAME

(71) Applicant: FUJIFILM Business Innovation Corp., Tokyo (JP)

(72) Inventors: Ryuga Oishi, Kanagawa (JP); Ryosuke Yamaji, Kanagawa (JP); Hiroyuki Tamai, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 139 days.

(21) Appl. No.: 17/901,607

(22) Filed: Sep. 1, 2022

(65) Prior Publication Data

US 2023/0312283 A1 Oct. 5, 2023

(30) Foreign Application Priority Data

Mar. 29, 2022 (JP) ..... 2022-052969

(51) Int. Cl.
*B65H 5/06* (2006.01)
*B65H 7/02* (2006.01)
*B65H 9/16* (2006.01)

(52) U.S. Cl.
CPC ..... *B65H 7/02* (2013.01); *B65H 5/062* (2013.01); *B65H 9/166* (2013.01);
(Continued)

(58) Field of Classification Search
CPC ..... B65H 5/062; B65H 7/02; B65H 9/166; B65H 9/004; B65H 9/006; B65H 2511/13;
(Continued)

(56) References Cited

U.S. PATENT DOCUMENTS 8,770,581 B2 * 7/2014 Deno ..... B65H 9/002 271/228
8,851,470 B2 * 10/2014 Matsumoto ..... B65H 7/02 271/228

(Continued)

FOREIGN PATENT DOCUMENTS

JP H10-109778 A 4/1998
JP 2017-024844 A 2/2017
JP 2019-215499 A 12/2019

*Primary Examiner* — Luis A Gonzalez
(74) *Attorney, Agent, or Firm* — Oliff PLC

(57) ABSTRACT

A medium transport device includes: a first transport unit on a front side and a first transport unit on a rear side that are respectively disposed in a front part and a rear part of a region having a length in a transport direction of a medium having a transportable minimum size and that transport the medium while nipping the medium; a second transport unit that is disposed between the first transport units and that transports the medium while nipping the medium and pulling the nipped medium outward in a width direction intersecting the transport direction; and a controller that performs control so that the medium transport device transports the medium while nipping the medium by using only the second transport unit when the medium is a thin medium having a thickness less than or equal to a predetermined thickness and so that the medium transport device transports the medium while nipping the medium by using the first transport units and the second transport unit when the medium is a medium other than the thin medium.

13 Claims, 9 Drawing Sheets

(52) U.S. Cl.
CPC ..... *B65H 2301/331* (2013.01); *B65H 2404/1422* (2013.01); *B65H 2511/13* (2013.01); *B65H 2511/24* (2013.01)

(58) Field of Classification Search
CPC ..... B65H 2511/224; B65H 2511/22; B65H 2404/1441; B65H 2404/144
See application file for complete search history.

(56) References Cited

U.S. PATENT DOCUMENTS

| | | | | |
|---|---|---|---|---|
| 9,340,385 | B2 * | 5/2016 | Deno | B65H 1/266 |
| 2023/0038655 | A1 * | 2/2023 | Shimosaka | B65H 5/06 |

* cited by examiner

MEDIUM TRANSPORT DEVICE AND MEDIUM PROCESSING APPARATUS INCLUDING THE SAME

CROSS-REFERENCE TO RELATED APPLICATIONS

This application is based on and claims priority under 35 USC 119 from Japanese Patent Application No. 2022-052969 filed Mar. 29, 2022.

BACKGROUND

(i) Technical Field

The present disclosure relates a medium transport device that transports media having different thicknesses and a medium processing apparatus including the medium transport device.

(ii) Related Art

To date, as medium transport devices of this type, devices described in, for example, Japanese Unexamined Patent Application Publication Nos. 10-109778, 2017-24844, and 2019-215499 are known.

Japanese Unexamined Patent Application Publication No. 10-109778 (Description of Embodiments, FIGS. 1 to 3) discloses a sheet transport mechanism that includes a driving roller and a driven roller that rotate in pressed-contact with each other. The roller diameter of a part of the driven roller in the axial direction is smaller than the roller diameter of another part of the driven roller.

Japanese Unexamined Patent Application Publication No. 2017-24844 (Description of Embodiments, FIG. 4) discloses a sheet feeding device that functions as follows. When feeding a thin sheet having a small basis weight, a driving unit rotates a movement member to cause the movement member to protrude from a base portion into a body to expand a sheet feed roller into a spindle shape to reduce the area of contact with the sheet. When feeding a thick sheet having a large basis weight, the driving unit rotates the movement member to pull the movement member from the inside of the body into the base portion to allow the sheet feed roller to recover a cylindrical shape to increase the area of contact with the sheet.

Japanese Unexamined Patent Application Publication No. 2019-215499 (Description of Embodiments, FIG. 7) discloses an image forming apparatus that pulls a continuous sheet outward in the width direction by using an expander roller to suppress generation of a crease in the continuous sheet.

SUMMARY

Aspects of non-limiting embodiments of the present disclosure relate to providing an appropriate transport power to media having different thicknesses and suppressing generation of a crease in a medium having a small thickness in order to enable transporting of media having different thicknesses.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a medium transport device including: a first transport unit on a front side and a first transport unit on a rear side that are respectively disposed in a front part and a rear part of a region having a length in a transport direction of a medium having a transportable minimum size and that transport the medium while nipping the medium; a second transport unit that is disposed between the first transport units and that transports the medium while nipping the medium and pulling the nipped medium outward in a width direction intersecting the transport direction; and a controller that performs control so that the medium transport device transports the medium while nipping the medium by using only the second transport unit when the medium is a thin medium having a thickness less than or equal to a predetermined thickness and so that the medium transport device transports the medium while nipping the medium by using the first transport units and the second transport unit when the medium is a medium other than the thin medium.

BRIEF DESCRIPTION OF THE DRAWINGS

Exemplary embodiments of the present disclosure will be described in detail based on the following figures, wherein.

DETAILED DESCRIPTION

Overview of Exemplary Embodiments

Figure 1A:
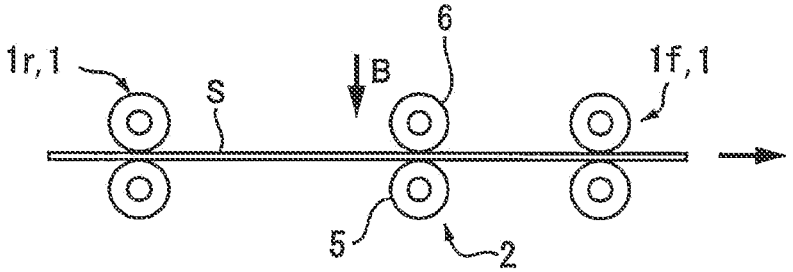
FIG. 1A schematically illustrates a medium transport device according to an exemplary embodiment of the present disclosure.
Figure 1B:
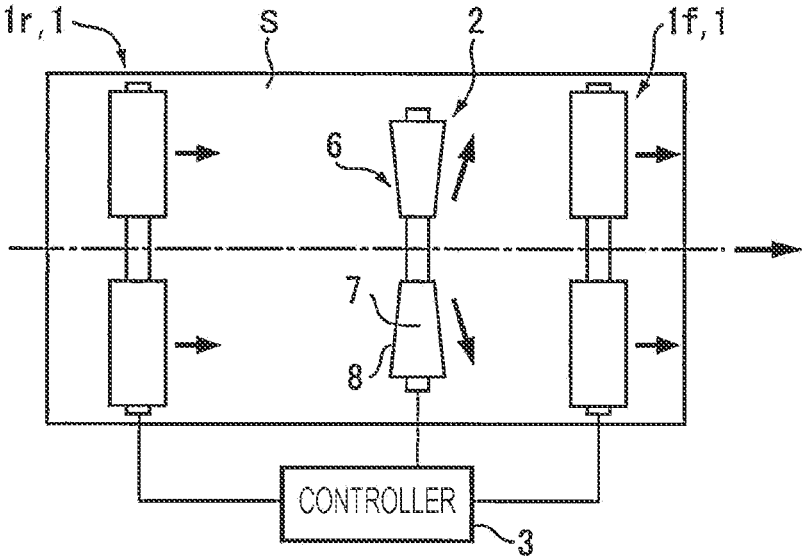
FIG. 1B is a view as seen in the direction of arrow B in FIG. 1A.

FIG. 1A schematically illustrates a medium transport device according to an exemplary embodiment of the present disclosure, and FIG. 1B illustrates the medium transport device as seen in the direction of arrow B in FIG. 1A.

Figure 1C:
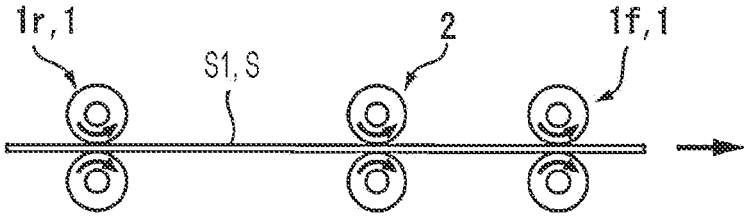
FIG. 1C illustrates an example of the operation of the medium transport device when transporting a medium other than a thin medium.
Figure 1D:
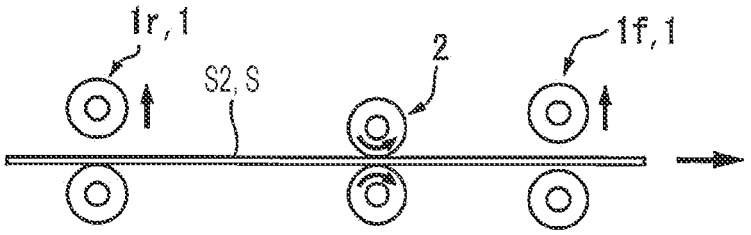
FIG. 1D illustrates an example of the operation of the medium transport device when transporting a thin medium.

In FIGS. 1A and 1B, the medium transport device includes: a first transport unit 1 on a front side and a first transport unit 1 on a rear side that are respectively disposed in a front part and a rear part of a region having a length in a transport direction of a medium S having a transportable minimum size and that transport the medium S while nipping the medium S; a second transport unit 2 that is disposed between the first transport units 1 and that transports the medium S while nipping the medium S and pulling the nipped medium S outward in a width direction intersecting the transport direction; and a controller 3 that performs control so that the medium transport device transports the medium while nipping the medium by using only the second transport unit 2 as illustrated in FIG. 1D when the medium S is a thin medium having a thickness less than or equal to a predetermined thickness and so that the medium transport device transports the medium S while nipping the medium S by using the first transport units 1 and the second transport unit 2 as illustrated in FIG. 1C when the medium S is a medium other than the thin medium.

The medium transport device of this type is used as a device that is incorporated in a medium processing apparatus including a processing unit (not shown) that performs predetermined processing on the medium S and that has a function of transporting the medium S to the processing unit or transporting the medium S processed in the processing unit.

Here, the term "processing unit" refers not only to an image forming unit that forms an image on the medium S but also to any units that perform various processing operations, such as punching, cutting, sorting, folding, and the like on the medium S.

Such technical units may be used for a thin medium in which a crease is likely to be generated when the medium is transported by elements of the first transport units 1 on the front and rear sides. For example, a thin medium of 60 gsm or less may be selected as appropriate.

The first transport units 1 and the second transport unit 2 may have any configuration that allows these units to transport the medium S while nipping the medium S. Typically, the first transport units 1 and the second transport unit 2 may each include a driving rotor and a driven rotor that is rotated in contact with the driving rotor. Here, the driving rotor or the driven rotor need not be configured as a roller, and may be a belt, a roller pair, or a combination of a roller and a belt.

Moreover, the second transport unit 2 may be any appropriate member that can transport the medium S while pulling the nipped medium S outward in the width direction intersecting the transport direction. The second transport unit 2 may be roller members that are symmetrically disposed on both sides in the axial direction of a rotary shaft, or may be one roller member having a peripheral surface configured so that the roller member can, while rotating, apply to the medium S an appropriate amount of power component that pulls the medium S outward in the width direction intersecting the transport direction, in addition to power component in the transport direction.

The controller 3 performs control so that the medium transport device uses only the second transport unit 2 when the medium is a thin medium and so that the medium transport device uses the first transport units 1 and the second transport unit 2 when the medium is a medium other than the thin medium. Here, when the controller 3 does not use the first transport units 1, each of the first transport units 1 may be in a state in which the first transport unit 1 does not nip the medium S. For example, if the first transport unit 1 is configured as a pair of rollers, the first transport unit 1 may function as follows: one of the rollers is capable of coming into contact with or separated from the other roller, the pair of rollers are disposed to be in contact with each other when in use, and one of the rollers is separated from the other roller to release the contact state when not in use. The second transport unit 2 transports a medium S having any of different thicknesses S while nipping the medium S. Because the second transport unit 2 always contribute to the transport operation, the second transport unit 2 need not have a contactable-separable configuration similar to that of the first transport unit 1. However, the contact state of the second transport unit 2 may be temporarily cancelled at least manually, in consideration of clearing of paper jam of the medium S and the like.

Next, aspects of the medium transport device according to the present exemplary embodiment will be described.

First, the second transport unit 2 according to an aspect includes a driving rotor 5 and a driven rotor 6 that is rotated in contact with the driving rotor 5, the driven rotor 6 includes a pair of roller members 7 that are disposed symmetrically about a center in an axial direction, and an outer peripheral surface of each of the roller members 7 is formed as an outside-diameter increasing portion 8 whose outside diameter gradually increases outward in the axial direction. In the present aspect, the shape of the roller member 7 of the second transport unit 2 is formed as the outside-diameter increasing portion 8. The presence of the outside-diameter increasing portion 8 has an effect of applying a pulling force outward in the width direction to the medium S that is in contact with the outside-diameter increasing portion 8.

Here, the outside-diameter increasing portion is not limited to an inclined portion whose outside diameter continuously increases, and may be a multiple divided roller in which divided roller members having different outside diameters are multiply incorporated.

In the second transport unit 2 according to an aspect, a surface hardness of the driving rotor 5 of the second transport unit 2 is lower than a surface hardness of the driven rotor 6 of the second transport unit 2. The present aspect shows a relationship between the hardnesses of contact portions of the driving rotor 5 and the driven rotor 6, and it is intended to maintain the shape of the outside-diameter increasing portion 8 of the roller member 7 and to effectively apply a pulling force outward in the width direction to the medium S.

Moreover, in the second transport unit 2 according to an aspect, the second transport unit has a medium nipping pressure smaller than a medium nipping pressure of each of the first transport units 1. The present aspect relates to a method of setting an appropriate medium nipping pressure to the second transport unit 2. When a medium nipping pressure greater than or equal to a medium nipping pressure due to the first transport unit 1 is set for the thin medium S, a force that pulls the medium S outward in the width direction is too strong, and the thin medium S may be torn. Therefore, for the thin medium S, a medium nipping pressure that can prevent generation of a crease while enabling transport may be appropriately selected in a range smaller than the medium nipping pressure due to the first transport unit 1.

As an aspect when only the second transport unit 2 is used, each of the first transport units 1 includes a driven rotor that is rotated in contact with the driving rotor, the driving rotor and the driven rotor being capable of coming into contact with and separable from each other, and the controller 3 separates the driving rotor and the driven rotor of each of the first transport units 1 from each other to release a contact state when using only the second transport unit 2. In the present aspect, an element if of the first transport units 1 on the front side and an element 1*r* of the first transport units 1 on the rear side each include a driving rotor and a driven rotor, and the medium S can be transported by using only the second transport unit 2.

In the present aspect, the element if of the first transport units 1 positioned on the front side may also serve as an alignment transport unit that aligns a leading end position of the medium S in the transport direction. That is, in the present aspect, the element if of the first transport units 1 positioned on the front side may also serve as an alignment transport unit, and, the leading end position of the medium S may be aligned by stopping driving of the driving rotor and the driven rotor, which are capable of being contact with or separated from each other, while being continued to be in a contact state.

At this time, as an aspect suitable for alignment of the medium S, the second transport unit 2 may be disposed closer to the element if of the first transport units 1 positioned on the front side than to the element 1*r* of the first transport units 1 positioned on the rear side. In the present aspect, during alignment, the alignment transport unit forms as an abutting portion that serves as a reference for aligning the leading end position of the medium S, and the element 1*r* positioned on the rear side serves to form a loop in the medium S during alignment. Considering that it is difficult to form a loop when the second transport unit 2 is disposed closer to the element 1*r* positioned on the rear side, the present aspect makes it easier to form the loop, and allows drive to be easily shared with the element if positioned on the front side.

Moreover, as another aspect suitable for alignment of the medium S, when aligning the leading end position of the medium S with the element if of the first transport units 1 positioned on the front side, the controller 3 stops driving of the element if of the first transport units 1 positioned on the front side while maintaining a contact state and controls the element 1*r* of the first transport units 1 positioned on the rear side and the second transport unit 2 in accordance with a thickness of the medium S. In the present aspect, when aligning the medium S, the element if of the first transport units 1 positioned on the front side, which also serves as an alignment transport unit, is used as a bumper member for alignment.

As another aspect of the medium transport device, the medium transport device includes a discrimination unit that discriminates a thickness of the medium S, and the controller 3 controls the first transport units 1 and the second transport unit 2 based on a discrimination result of the discrimination unit. In the present aspect, the discrimination unit may be any unit that can discriminate the thickness (or a parameter related to the thickness) of the medium S, such as a detector for detecting the thickness of the medium S or a unit that specifies the medium S.

Moreover, as the layout of the medium transport device, although the medium transport device may be disposed in any medium transport path of the medium processing apparatus, it is effective that the medium transport device is disposed along a medium transport path that is curved. This aspect may be effectively used because a crease tends to be generated more frequently in a medium transport path that is curved than in a medium transport path that is straight.

Hereafter, exemplary embodiments of the present disclosure will be described in further detail with reference to the drawings.

First Exemplary Embodiment

Figure 2:
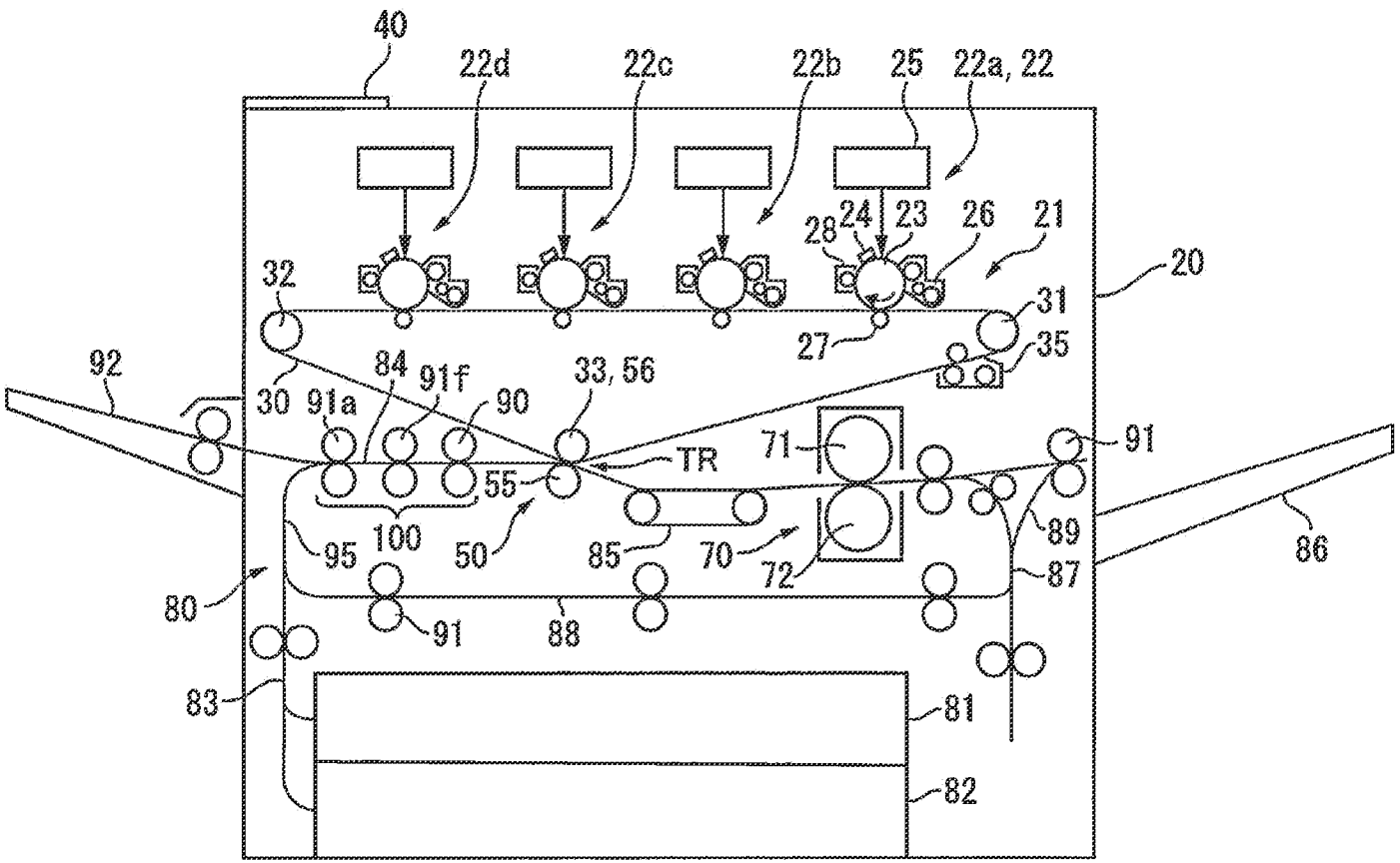
FIG. 2 illustrates the overall configuration of an image forming apparatus as a medium processing apparatus according to a first exemplary embodiment.

FIG. 2 illustrates the overall configuration of an image forming apparatus as a medium processing apparatus according to a first exemplary embodiment.

Overall Configuration of Image Forming Apparatus

In FIG. 2, basically, the image forming apparatus includes: an image forming engine 21 that is mounted in an apparatus housing 20 and that forms, for example, plural color-component images; a medium transport system 80 that is disposed below the image forming engine 21 and that transports a medium to the image forming engine 21; and a fixing device 70 that fixes the images formed by the image forming engine 21 onto the medium.

In the present exemplary embodiment, the image forming engine 21 includes: image forming units 22 (to be specific, image forming units 22*a* to 22*d*) that form general color images of plural color components (in the present exemplary embodiment, yellow (Y), magenta (M), cyan (C), and black (K)); a belt-shaped intermediate transfer body 30 to which the color-component images formed by the image forming units 22 are successively transferred (first-transferred) and holds the images; and a second-transfer device 50 (simultaneous transfer device) that second-transfers (simultaneously transfers) the color-component images transferred to the intermediate transfer body 30 onto a medium (a sheet or a film). Referring to FIG. 2, an operation panel 40 is used to operate the image forming apparatus.

Image Forming Unit

In the present exemplary embodiment, each of the image forming units 22 (22*a* to 22*d*) includes a drum-shaped photoconductor 23 and the following devices disposed around the photoconductor 23: a charger 24, such as a corotron or a transfer roller, that charges the photoconductor 23; an exposure device 25, such as a laser scanner, that forms an electrostatic latent image on the charged photoconductor 23; a developing device 26 that develops the electrostatic latent image formed on the photoconductor 23 by using a color toner in a corresponding one of the colors Y, M, C, and K; a first-transfer device 27, such as a transfer roller, that transfers the toner image on the photoconductor 23 to the intermediate transfer body 30; and a photoconductor cleaner 28 that removes the toner remaining on the photoconductor 23.

The intermediate transfer body 30 is looped over plural (in the present exemplary embodiment, three) span rollers 31 to 33. For example, the span roller 31 is used as a driving roller that is driven by a driving motor (not shown), and the intermediate transfer body 30 is moved in a circulating manner by the driving roller. Moreover, an intermediate transfer body cleaner 35, for removing toner remaining on the intermediate transfer body 30 after second-transfer, is disposed between the span rollers 31 and 33.

Second-Transfer Device (Simultaneous Transfer Device)

Moreover, the second-transfer device 50 (simultaneous transfer device) includes: a transfer roller 55 that is disposed in pressed-contact with the intermediate transfer body 30, for example, at a position where the intermediate transfer body 30 faces the span roller 33; and a counter roller 56 that is the span roller 33 for the intermediate transfer body 30 and that serves as a counter electrode for the transfer roller 55. Here, in the present exemplary embodiment, the transfer roller 55 has a configuration such that a metal shaft is covered by an elastic layer composed of foamed polyurethane rubber or EPDM including carbon black or the like. A transfer voltage from a transfer electric power source (not shown) is applied to the counter roller 56 (which also serves as the span roller 33 in the present exemplary embodiment) via an electroconductive power feed roller (not shown). On the other hand, a predetermined transfer electric field is formed between the transfer roller 55 and the counter roller 56 by grounding the transfer roller 55. Thus, a nip region of the intermediate transfer body 30 nipped between the transfer roller 55 and the counter roller 56 functions as a second transfer region TR (simultaneous transfer region). In the second-transfer device 50, the transfer roller 55 is used. However, the second-transfer device 50 is not limited to this, and, for example, a transfer belt module in which a transfer belt is looped over the transfer roller 55 as one of span rollers may be used.

Fixing Device

The fixing device 70 includes: a heat-fixing roller member 71 that is capable of drivingly rotate and that is disposed in contact with the image-holding surface of a medium; and a press-fixing roller member 72 that is disposed in press-contact with and so as to face the heat-fixing roller member 71 and that is rotated by the heat-fixing roller member 71. The fixing device 70 fixes an image, which is held on a medium, to the medium while the medium passes through a fixing region between the fixing rollers 71 and 72.

Here, for example, the heat-fixing roller member 71 includes a heater incorporated in a roller body or has an external heater in contact with an outer peripheral surface of the roller body to heat the roller body. As necessary, a heater may be added to the press-fixing roller member 72. In the present exemplary embodiment, a roller-pair configuration is used as an example. However, the configuration of the fixing device is not limited to this. As appropriate, the heat-fixing roller member 71 may be configured as a heat-fixing belt using, for example, an electromagnetic induction heating method.

Medium Transport System

Moreover, the medium transport system 80 includes plural (in the present exemplary embodiment, two) medium supply containers 81 and 82. The medium transport system 80 transports a medium, which is supplied from either of the medium supply containers 81 and 82, from a vertical transport path 83, which extends in a substantially vertical direction, through a horizontal transport path 84, which extends in a substantially horizontal direction, to a second transfer region TR. Subsequently, the medium transport system 80 transports the medium, which holds the transferred image thereon, to the fixing region of the fixing device 70 via a transfer belt 85, and outputs the medium to a medium output tray 86 disposed on a side of the apparatus housing 20.

Furthermore, the medium transport system 80 has a branch transport path 87 that branches downward from a part of the horizontal transport path 84 positioned downstream of the fixing device 70 in the medium transport direction and that can reverse a medium. The medium transport system 80 returns a medium that is reversed in the branch transport path 87 through a reverse transport path 88 from the vertical transport path 83 to the horizontal transport path 84, transfers an image to the back surface of the medium in the second transfer region TR, and outputs the medium to the medium output tray 86 through the fixing device 70. The branch transport path 87 includes a branch reverse transport path 89 that branches from a middle part thereof and that transports a reversed medium toward the medium output tray 86.

The medium transport system 80 includes an alignment roller 90, which supplies a medium after aligning the position of the medium and supplies the medium to the second transfer region TR, and an appropriate number of transport rollers 91 disposed in the transport paths 83, 84, 87, 88, and 89. Furthermore, a manual medium feeder 92, which is capable of feeding a manually suppled sheet toward the horizontal transport path 84, is disposed on a side of the apparatus housing 20 opposite to the medium output tray 86.

Necessity of Measures Against Crease

For an image forming apparatus of this type, it is required that sheets having different thicknesses (ranging from a thick sheet to a thin sheet) be widely used. In such requirement, there is a concern that a crease may be generated when a thin sheet of, for example, 80 gsm or less is used, and, in particular, when a thin sheet of 60 gsm or less is used.

Here, a crease is considered to be generated for the following reasons: when a thin sheet is being transported, a crease may be generated due to a small difference between the outside diameters of two end portions in the axial direction of transport rollers that are, for example, a pair of roller members; and in a case of a thin sheet, a crease may be generated as the thin sheet is excessively pressed in a contact region due to transport power of a transport roller because, in order to transport a thick sheet other than a thin sheet, a method of setting the transport power of the transport roller appropriately high for the thick sheet is used.

To date, technologies for suppressing generation of a crease by adding an adjustment mechanism for adjusting transport power in accordance with sheets having different thicknesses have been proposed. Moreover, apparatuses of a type that tunes a medium transport device so as to be specifically used for a thin sheet have been proposed.

However, with the former measures, various components such as motors and sensors are necessary in order to introduce the adjustment mechanism for adjusting transport power, the configuration become complex and the number of components increases, and it is necessary to provide a sufficient space for setting the adjustment mechanism. Therefore, although it may be possible to introduce the adjustment mechanism in a comparatively large high-functionality apparatus, it is difficult to introduce the adjustment mechanism in an inexpensive small apparatus.

With the latter measures, when tuning of the medium transport device is performed to specifically handle a thin sheet, the thick-sheet transport performance considerably decreases and it becomes difficult to perform thick-sheet transport. In addition, it may be necessary for a professional repairman to perform repair work to enable thick-sheet transport.

Thus, based on the configuration of an existing medium transport device, it is examined in the present exemplary embodiment to use of a method of achieving high transport performance for each of media having different thicknesses by adding a transport component suitable for transporting a thin medium.

Fundamental Configuration of Medium Transport Device

Figure 3:
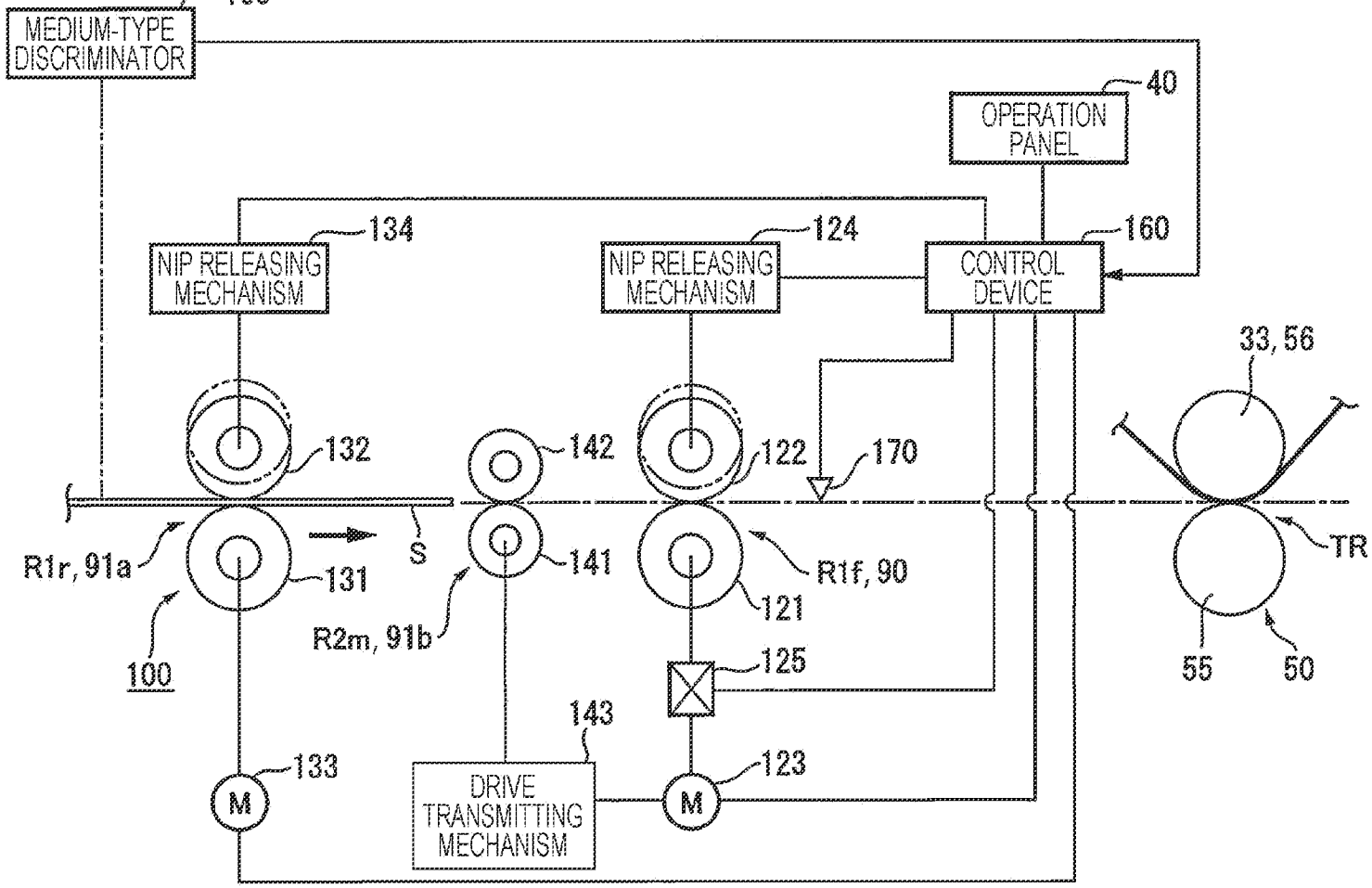
FIG. 3 illustrates a medium transport device used in the first exemplary embodiment and components surrounding the medium transport device.
Figure 4A:
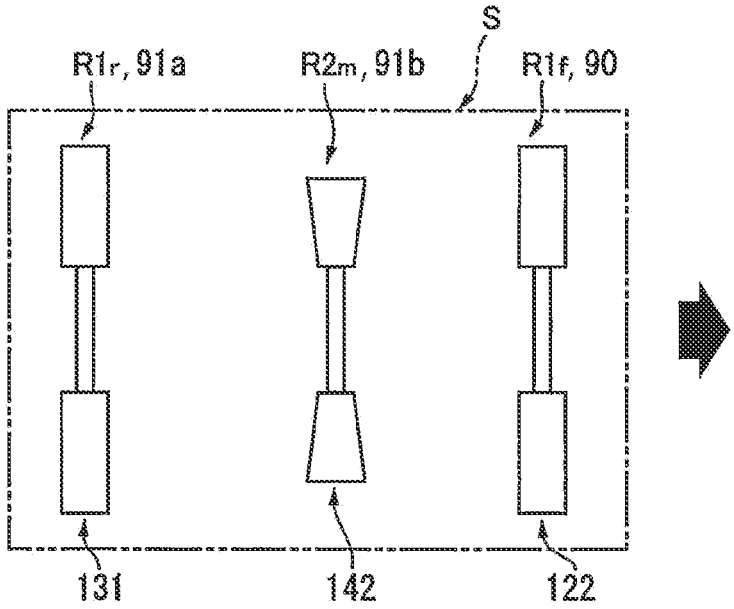
FIG. 4A is a plan view illustrating the layout of transport elements of the medium transport device.

As illustrated in FIGS. 3 and 4A, in the present exemplary embodiment, a medium transport unit 100 is incorporated in a region in which a medium S reaches the second transfer region TR after the leading end position of the medium S is aligned when transporting the medium S to the second transfer region TR.

In the present exemplary embodiment, the medium transport unit 100 includes: a front transport roller R1 and a rear transport roller R1 as first transport units (to be specific, a front transport roller R1*f* positioned on a front side and a rear transport roller R1*r* positioned on a rear side) that are respectively disposed in a front part and a rear part of a region having a length in a transport direction of a medium S having a transportable minimum size and that transport the medium S while nipping the medium S; a middle transport roller R2*m* that is disposed between the front transport roller R1*f* and the rear transport roller R1*r* and that transports the medium S while nipping the medium S and pulling the nipped medium S outward in a width direction intersecting the transport direction; and a control device 160 that performs control so that the medium transport unit 100 transports the medium S while nipping the medium S by using only the middle transport roller R2*m* when the medium S is a thin medium having a thickness less than or equal to a predetermined thickness and so that the medium transport unit 100 transports the medium S while nipping the medium S by using the front and rear transport rollers R1 (R1*f*, R1*r*) and the middle transport roller R2*m* when the medium S is a medium other than the thin medium.

As illustrated in FIGS. 2, 3, and 4A, in the present exemplary embodiment, the front transport roller R1*f* also serves as the alignment roller 90 that aligns the leading end position of the medium S.

The rear transport roller R1*r* and the middle transport roller R2*m* correspond to the transport rollers 91 (to be specific, 91*a* and 91*b*) that are set on the upstream side of the alignment roller 90 in the transport direction.

Front Transport Roller

As illustrated in FIGS. 3 and 4A, the alignment roller 90 as the front transport roller R1*f* includes a driving roller 121 that has a roller body around a rotary shaft made of a metal and a driven roller 122 that is rotated in contact with the driving roller 121 and has a roller body around a rotary shaft made of a metal. Here, each of the roller bodies is made by forming a layer of an elastic material such as polyurethane rubber or the like around a rotation shaft and coating the surface of the elastic material with a protective layer (a mold-release layer of a fluorocarbon resin or the like).

A driving motor 123 is drivingly coupled to the driving roller 121 via a drive transmitting component (not shown). The driven roller 122 is supported by a nip releasing mechanism 124 and moves to come into contact with or separate from (nip release) the driving roller 121. The driven roller 122 forms a contact region (nip region) for nipping the medium S between the driven roller 122 and the driving roller 121, and moves to a retracted position separated from the contact region. In the present exemplary embodiment, the nip pressure (corresponding to the contact pressure for nipping the medium S) in the contact region is selected to be in the range of about 35 to 40 $N/m^2$.

Regarding the alignment roller 90, when aligning the leading end of the medium S, the nipping state of the driven roller 122 with respect to the driving roller 121 is maintained, and driving of the driving roller 121 by the driving motor 123 is temporarily stopped.

Rear Transport Roller

The transport roller 91*a* as the rear transport roller R1*r* includes a driving roller 131 and a driven roller 132, as with the alignment roller 90. The driving roller 131 is drivingly coupled to a driving motor 133 via a drive transmitting component (not shown), and the driven roller 132 is supported by a nip releasing mechanism 134.

The nip pressure in the contact region of the transport roller 91*a* is also selected to be in the range of about 35 to 40 $N/m^2$, as with the alignment roller 90.

Middle Transport Roller

As illustrated in FIGS. 2, 3, 4A, and 4B, the transport roller 91*b* as the middle transport roller R2*m* includes a driving roller 141 and a driven roller 142, as with the alignment roller 90. In the present exemplary embodiment, the transport roller 91*b* is disposed closer to the alignment roller 90 than to the transport roller 91*a* as the rear transport roller R1*r*.

Here, the driving roller 141 is drivingly coupled to a driving motor via a drive transmitting mechanism 143 such as a drive-transmitting gear train. The driving roller 141, which is disposed closer to the alignment roller 90, shares the driving motor 123 with the alignment roller 90. On the other hand, the driven roller 142 is not supported by a nip releasing mechanism, in contrast to the front transport roller R1*f* and the rear transport roller R1*r*. However, the driven roller 142 is supported by a structure that allows the driven roller 142 to be temporarily and manually retractable with respect to the driving roller 141 when clearing paper jam.

In the present exemplary embodiment, the driving motor 123 of the alignment roller 90 also servers to drive the transport roller 91*b*. Because there is a case where driving of the alignment roller 90 is stopped and the transport roller 91*b* is driven when aligning the medium S, a drive interruption mechanism 125 such as a clutch for interrupting transmission of driving power is set between the driving motor 123 and the driving roller 121.

Shape of Middle Transport Roller

Figure 4B:
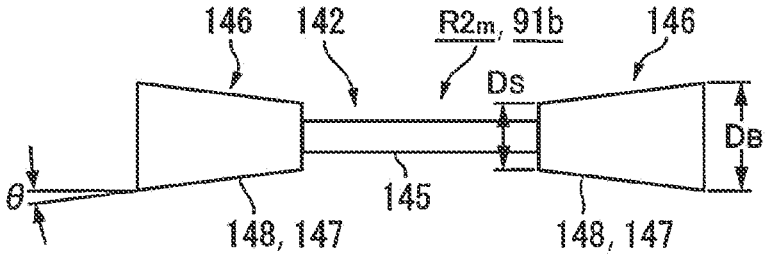
FIG. 4B illustrates a configuration example of a middle transport element.

As illustrated in FIGS. 4A and 4B, the driven roller 142 includes a pair of roller members 146 that are disposed symmetrically about the center of a rotary shaft 145 in the axial direction, and the outer peripheral surface of each of the roller members 146 is formed as an outside-diameter increasing portion 147 whose outside diameter gradually increases outward in the axial direction.

In particular, in the present exemplary embodiment, the outside-diameter increasing portion 147 is configured as an inclined portion 148 whose outside diameter gradually and continuously increases from a small diameter $D_S$ to a large diameter $D_B$. The inclined portion 148 is inclined at an inclination angle θ with respect to a reference line parallel to the axial direction. Here, the inclination angle θ is selected to be in the range of about 0.13 to 0.17°.

In the present exemplary embodiment, the inclined portion 148 is an example of the outside-diameter increasing portion 147. For example, instead of in the pair of roller members 146, inclined portions 148 may be formed in one roller member (not shown) at positions that are symmetrical about the center of the rotary shaft 145 in the axial direction.

Contact Region of Middle Transport Roller

In the present exemplary embodiment, for example, the roller member 146 is formed from polyurethane resin rubber or the like to have a hollow truncated-cone shape. The roller member 146 is fitted onto the rotary shaft 145, and the peripheral surface thereof is coated with a protective layer (for example, a mold-release layer of a fluorocarbon resin or the like).

On the other hand, the driving roller 141 includes a roller body around the rotary shaft, and the outside diameter of roller body is uniform. The surface hardness of the roller member 146 of the driven roller 142 is higher than the surface hardness of the roller body of the driving roller 141. The contact region of the driving roller 141 and the driven roller 142 is formed in a state in which the inclined portion 148 of the roller member 146 nips into the roller body of the driving roller 141.

The nip pressure in the contact region of the driving roller 141 and the driven roller 142 (corresponding the contact pressure for nipping the medium S) is sufficiently smaller than those of the alignment roller 90 and the transport roller 91*a*, and, for example, is selected to be in the range of about 9 to 11 $N/m^2$.

Configuration of Components Surrounding Medium Transport Device

Position Sensor

Referring to FIG. 3, a position sensor 170 is disposed immediately on the downstream side of the alignment roller 90 in the transport direction of the medium S. The position sensor detects whether or not the leading end of the medium S that has passed the alignment roller 90 is in a skewed state. The position sensor 170 includes two portions that are separately disposed near two ends in the width direction intersecting the transport direction of the medium S. The distance between the two portions of the position sensor 170 is set smaller than the width of the medium S that can be used. Thus, the position sensor 170 is capable of detecting the timing at which the leading end or the trailing end of the medium S passes the alignment roller 90.

With the position sensor 170, it is possible to check that the transport posture of the medium S is not in a skewed state and is straight.

Medium-Type Discriminator

In the present exemplary embodiment, for example, as illustrated in FIG. 3, a medium-type discriminator 180 is disposed. The medium-type discriminator 180 includes: a thickness detector that directly detects whether a sheet as the medium S is, for example, a thin sheet of 60 gsm or less or a thick sheet other than the thin sheet; a medium specifier (included, for example, in the operation panel 40 in FIG. 2) that prepares a medium-type table of usable medium types in a memory of the control device 160 and specifies a medium to be used from the medium-type table; or the like.

Control System of Medium Transport Device

As illustrated in FIG. 3, in the present exemplary embodiment, the control device 160 for appropriately aligning and transporting media having different thicknesses S is disposed.

The control device 160 is configured as a microcomputer including processors of various types. Here, the term "processor" refers to a processor in a broad sense, and includes general-purpose processor (for example, a central processing unit (CPU) or the like) and a dedicated processor (such as a graphics processing unit (GPU), an application specific integrated circuit (ASIC), a field programmable gate array (FPGA), a programmable logic device, or the like).

In the present exemplary embodiment, the control device 160 stores necessary programs such as a medium transport control program (see FIG. 5, including an alignment operation of aligning the medium S) and the like beforehand in a memory (not shown), executes the medium transport control program based on discrimination information of the medium S from the medium-type discriminator 180, and, after appropriately performing an alignment operation of aligning media having different thicknesses S (represented as "registration operation" in FIG. 5), transports the media having different thicknesses S toward the second transfer region TR with appropriate transport power.

Control Operation of Controlling Medium Transport Device

Alignment Operation of Aligning Medium

Figure 5:
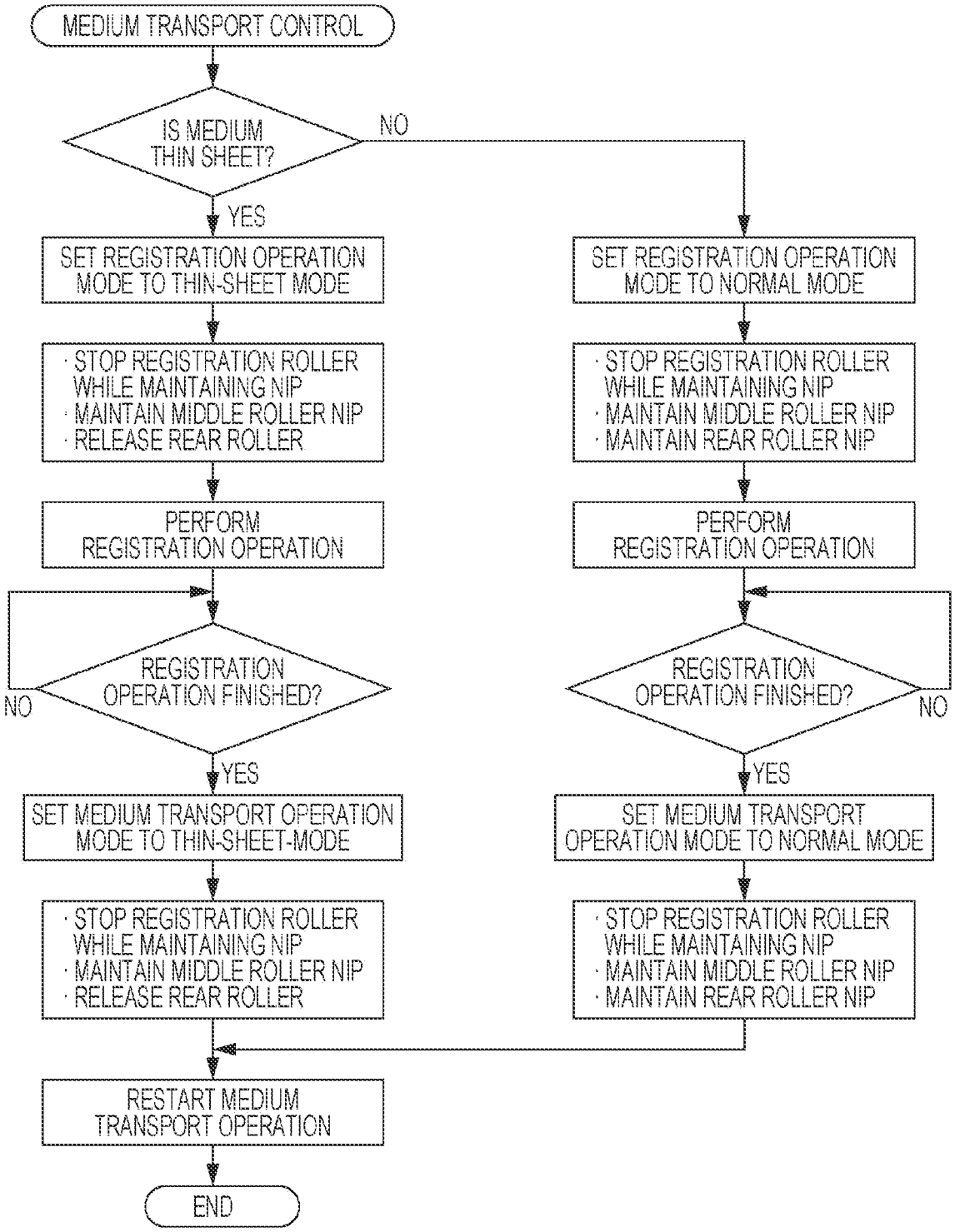
FIG. 5 is a flowchart illustrating medium transport control performed by a medium transport device used in the first exemplary embodiment.

As illustrated in FIG. 5, the control device 160 recognizes whether a sheet S to be transported is a thin sheet or a thick sheet other than the thin sheet based on a discrimination signal from the medium-type discriminator 180.

Normal Mode

First, a case where the medium S is a thick sheet S1 other than a thin sheet will be described. The control device 160 sets the mode of an alignment operation of aligning the medium S (registration operation) to a "normal mode".

Figure 6A:
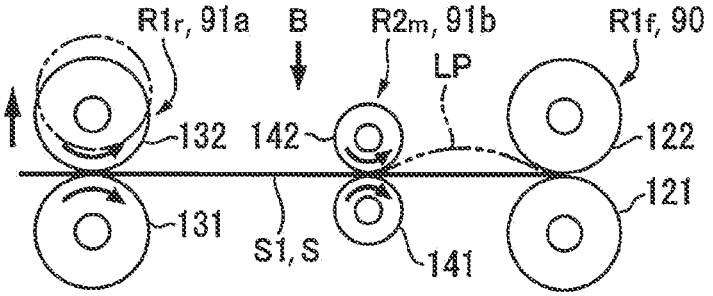
FIG. 6A illustrates the behavior of the medium transport device when aligning a medium other than a thin medium.
Figure 6B:
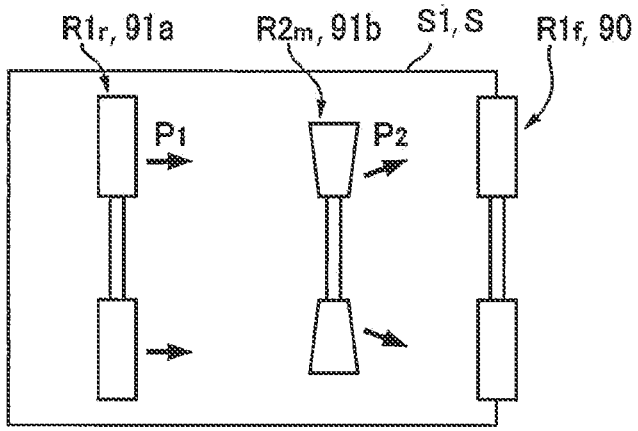
FIG. 6B illustrates the medium transport device as seen in the direction of arrow B in FIG. 6A.

As illustrated in FIGS. 6A and 6B, at this time, in the normal mode, driving of the alignment roller 90 (represented as "registration roller" in FIG. 5) as the front transport roller R1*f* is stopped while maintaining a nip by causing the drive interruption mechanism 125 (see FIG. 3) to be in a drive-interrupting state. On the other hand, the transport roller 91*a* (represented as "rear roller" in FIG. 5) as the rear transport roller R1*r* is driven while maintaining a nip. Moreover, the transport roller 91*b* (represented as "middle roller" in FIG. 5) as the middle transport roller R2*m* is driven while maintaining a nip.

In this state, the medium S1 (thick sheet) is transported by the transport rollers 91*a* and 91*b*. In addition to transport power P1 due to the transport roller 91*a*, transport power P2 due to the transport roller 91*b* is applied. Therefore, compared with a case where the alignment operation is performed by using only the transport roller 91*a*, the transport power applied to the medium S1 increases to P1+P2.

Subsequently, as shown by an imaginary line in FIG. 6A, when the leading end position of the medium S1 abuts against the alignment roller 90, a correction loop LP for alignment is formed in a leading end portion of the medium S1. Then, when the nip releasing mechanism 134 releases the nipping state of the transport roller 91*a*, the leading end position of the medium S1 is aligned by the alignment roller 90 while the correction loop LP of the medium S1 recovers a flat shape. Although the transport roller 91*b* is driven while maintaining a nip to press the medium S1 toward the alignment roller 90 during this time, the nip pressure of the transport roller 91*b* is small and the transport power P2 of the transport roller 91*b* is small, and thus the alignment operation of aligning the medium S1 is not hindered.

Thin-Sheet Mode

Next, a case where the medium S is a thin sheet S2 will be described. The control device 160 sets the mode of the alignment operation of aligning the medium S (registration operation) to a "thin-sheet mode".

Figure 7A:
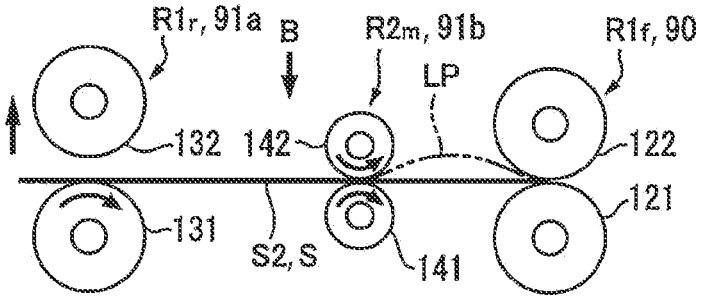
FIG. 7A illustrates the behavior of the medium transport device when aligning a thin medium.
Figure 7B:
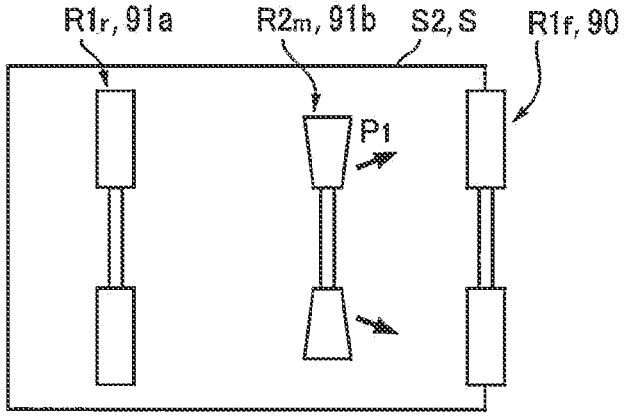
FIG. 7B illustrates the medium transport device as seen in the direction of arrow B in FIG. 7A.

As illustrated in FIGS. 7A and 7B, at this time, in the thin-sheet mode, driving of the alignment roller 90 (represented as "registration roller" in FIG. 5) as the front transport roller R1*f* is stopped while maintaining a nip by causing the drive interruption mechanism 125 (see FIG. 3) to be in an interrupted state. On the other hand, the nipping state of the transport roller 91*a* (represented as "rear roller" in FIG. 5) as the rear transport roller R1*r* is released by using the nip releasing mechanism 134. Moreover, the transport roller 91*b* (represented as "middle roller" in FIG. 5) as the middle transport roller R2*m* is driven while maintaining a nip.

In this state, because the nipping state of the transport roller 91*a* is released, the transport power P1 is not transmitted from the transport roller 91*a* to the medium S2, although the driving roller 131 is rotated. Therefore, the medium S2 (thin sheet) is transported by only the transport roller 91*b*, and the transport power P2 due to the transport roller 91*b* is applied. At this time, the medium S2 is transported toward the alignment roller 90 while being pulled outward in the width direction, because the transport power P2 due to the transport roller 91*b* has a component outward in the width direction of the medium S2 in addition to a component in the transport direction of the medium S2. Thus, the strong transport power P1 due to the transport roller 91*a* is not applied to the medium S2, and the mediums S2 is transported by small transport power while being pulled outward in the width direction, and thus there is no concern that a crease is generated in the medium S2 during the alignment operation.

Subsequently, as shown by an imaginary line in FIG. 7A, when the leading end of the medium S2 abuts against the alignment roller 90, a correction loop LP for alignment is formed in a leading end portion of the medium S2. However, because the nipping state of the transport roller 91*a* is continued to be released, the leading end position of the medium S2 is aligned by the alignment roller 90 while the correction loop LP of the medium S2 recovers a flat shape. Although the transport roller 91*b* is driven while maintaining a nip to press the medium S2 toward the alignment roller 90 during this time, the nip pressure of the transport roller 91*b* is small and the transport power P2 of the transport roller 91*b* is small, and thus the alignment operation of aligning the medium S2 is not hindered.

Restarting of Transport Operation of Transporting Medium

When the aforementioned alignment operation of aligning the medium finishes, a transport operation of transporting the aligned medium S (S1 or S2) is restarted.

Normal Mode

First, a case where the medium S is a thick sheet S1 other than a thin sheet will be described. The control device 160 sets the mode of the transport operation of transporting the medium S to a "normal mode".

Figure 6C:
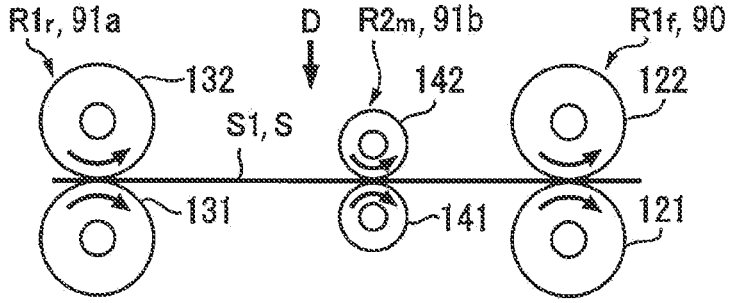
FIG. 6C illustrates the behavior of the medium transport device when transporting the medium other than a thin medium after alignment.
Figure 6D:
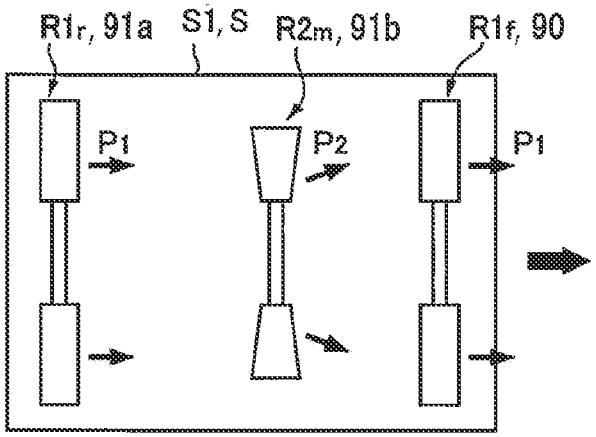
FIG. 6D illustrates the medium transport device as seen in the direction of arrow D in FIG. 6C.

As illustrated in FIGS. 6C and 6D, at this time, in the normal mode, driving of the alignment roller 90 (represented as "registration roller" in FIG. 5) as the front transport roller R1*f* is started by causing the drive interruption mechanism 125 to be in a drive-transmitting state while maintaining a nip. On the other hand, the transport roller 91*a* (represented as "rear roller" in FIG. 5) as the rear transport roller R1*r* is driven while maintaining a nip. Moreover, the transport roller 91*b* (represented as "middle roller" in FIG. 5) as the middle transport roller R2*m* is continued to be driven while maintaining a nip.

In this state, the medium S1 (thick sheet) is transported by the alignment roller 90 and the transport rollers 91*a* and 91*b*. In addition to the transport power P1 due to the alignment roller 90 and the transport power P1 due to the transport roller 91*a*, transport power P2 due to the transport roller 91*b* is applied. Therefore, the entire transport power of the alignment roller 90 and the transport rollers 91*a* and 91*b* is applied to the medium S1, and the transport operation of transporting the medium S1 is restarted from the alignment roller 90 toward the second transfer region TR.

At this time, compared with a case where two transport members that are the alignment roller 90 and the transport roller 91*a* are used, the medium S1 is stably transported by stronger transport power, because the transport power P2 due to the transport roller 91*b* is added to the transport power applied to the medium S1. There is no concern that a crease is generated in the medium S1 (thick sheet), because the rigidity of the medium S1 is intrinsically high.

Thin-Sheet Mode

Next, a case where the medium S is a thin sheet S2 will be described. The control device 160 sets the mode of a transport operation of transporting the medium S to a "thin-sheet mode".

Figure 7C:
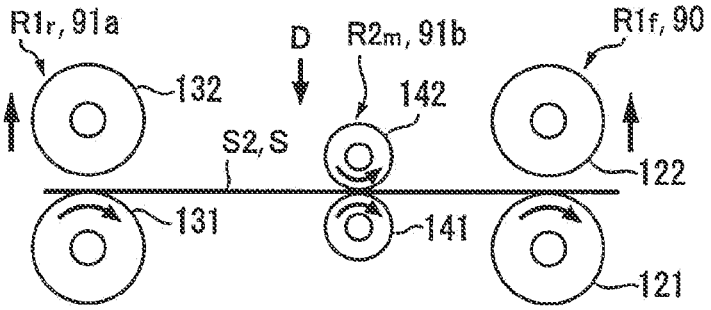
FIG. 7C illustrates the behavior of the medium transport device when transporting the thin medium after alignment.
Figure 7D:
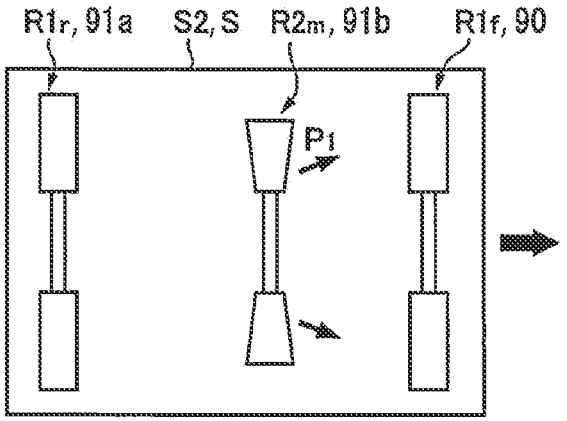
FIG. 7D illustrates the medium transport device as seen in the direction of arrow D in FIG. 7C.

As illustrated in FIGS. 7C and 7D, at this time, in the thin-sheet mode, the nipping state of the alignment roller 90 (represented as "registration roller" in FIG. 5) as the front transport roller R1*f* is released by using the nip releasing mechanism 124 and driving of the alignment roller 90 is started by causing the drive interruption mechanism 125 to be in a drive transmitting state. On the other hand, the nipping state of the transport roller 91*a* (represented as "rear roller" in FIG. 5) as the rear transport roller R1*r* is released by the nip releasing mechanism 134. Moreover, the transport roller 91*b* (represented as "middle roller" in FIG. 5) as the middle transport roller R2*m* is continued to be driven while maintaining a nip.

In this state, because the nipping state of each of the alignment roller 90 and the transport roller 91*a* is released, although the driving roller 121 and the driving roller 131 are rotated, the transport power P1 is not transmitted from the alignment roller 90 and the transport roller 91*a* to the medium S2. Therefore, the medium S2 (thin sheet) is transported by only the transport roller 91*b*, and the transport power P2 due to the transport roller 91*b* is applied. At this time, because the transport power P2 due to the transport roller 91*b* has a component outward in the width direction of the medium S2 in addition to a component in the transport direction of the medium S2, the medium S2 is transported toward the alignment roller 90 while being pulled outward in the width direction. Thus, the strong transport power P1 due to the transport roller 91*a* is not applied to the medium S2, the mediums S2 is transported by small transport power while being pulled outward in the width direction, and thus there is no concern that a crease is generated in the medium S2 during the alignment operation.

Comparative Example 1

Next, referring to FIGS. 8A and 8B, a medium transport device according to a comparative example 1 will be described in order to examine the performance of the medium transport device according to the present exemplary embodiment.

Figure 8A:
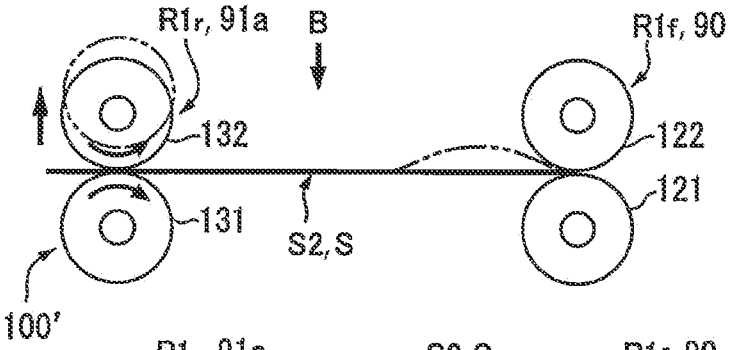
FIG. 8A illustrates the behavior of a medium transport device according to a comparative example 1 when aligning a thin medium.
Figure 8B:
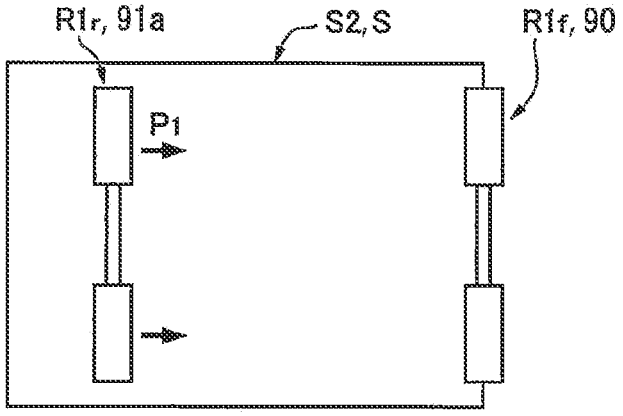
FIG. 8B illustrates the medium transport device as seen in the direction of arrow B in FIG. 8A.

As illustrated in FIGS. 8A and 8B, a medium transport unit 100' according to the comparative example 1 includes the alignment roller 90 as the front transport roller R1*f* and the transport roller 91*a* as the rear transport roller R1*r*, but does not include the transport roller 91*b* as the middle transport roller R2*m*.

In the comparative example 1, for example, the alignment operation of aligning the medium S and restarting of the transport operation of transporting the medium S after the aligning operation are controlled in a similar way irrespective of whether the thick sheet S1 or the thin sheet S2 is used as the medium S.

First, in the alignment operation when using the thin sheet S as the medium S, driving the alignment roller 90 as the front transport roller R1*f* is stopped while maintaining a nip. On the other hand, the transport roller 91*a* as the rear transport roller R1*r* is driven while maintaining a nip.

In this state, the strong transport power P1 due to the transport roller 91*a* is applied to the medium S2. Because the transport power P1 due to the transport roller 91*a* does not include a pulling force outward in the width direction of the medium S2, there is a concern that a crease is generated in the medium S2 during the alignment operation.

Figure 8C:
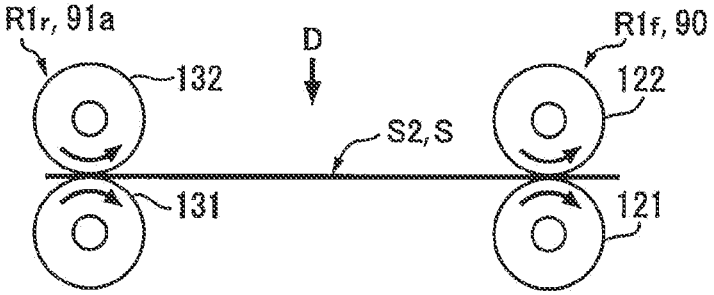
FIG. 8C illustrates the behavior of the medium transport device according to the comparative example 1 when transporting the thin medium after alignment.
Figure 8D:
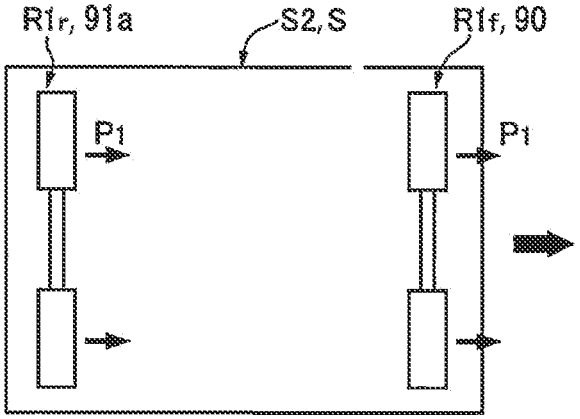
FIG. 8D illustrates the medium transport device as seen in the direction of arrow D in FIG. 8C.

As illustrated in FIGS. 8C and 8D, when restarting the transport operation of transporting the thin sheet S2 as the medium S, rotation of the alignment roller 90 as the front transport roller R1*f* is started while maintaining a nip. On the other hand, the transport roller 91*a* as the rear transport roller R1*r* is driven while maintaining a nip.

In this state, the strong transport power P1 due to the alignment roller 90 and the transport roller 91*a* is applied to the medium S2. Because the transport power P1 due to the alignment roller 90 and the transport roller 91*a* does not include a pulling force outward in the width direction of the medium S2, there is a concern that a crease is generated in the medium S2 when restarting the transport operation of transporting the medium S2.

Figure 9A:
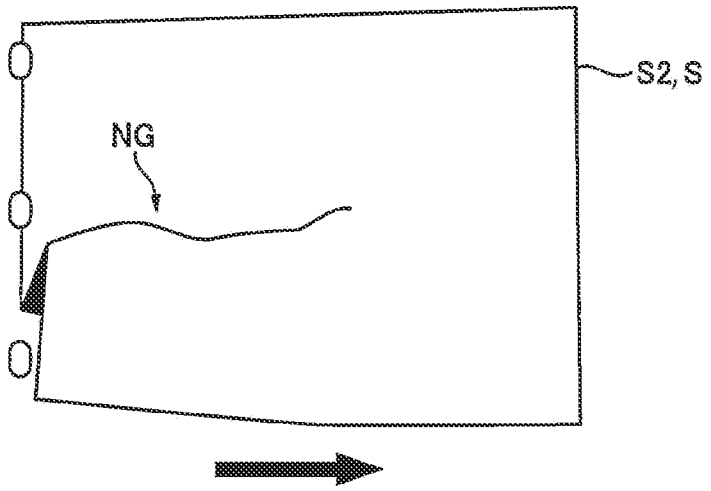
FIG. 9A illustrates an example of a crease that is generated when a thin medium is transported by the medium transport device according to the comparative example 1.
Figure 9B:
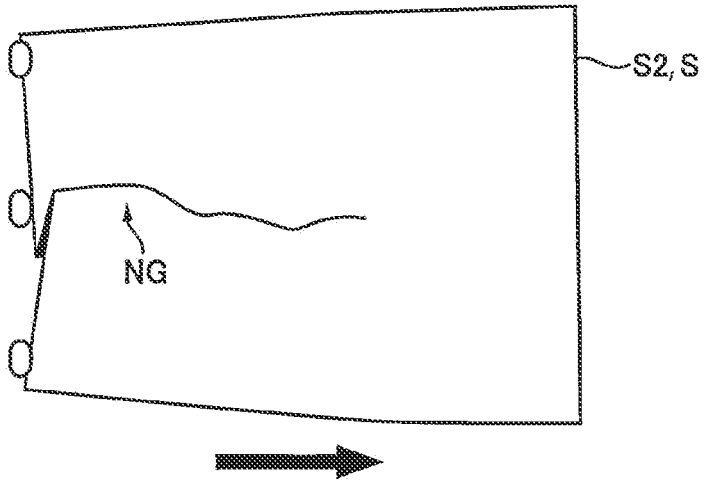
FIG. 9B illustrates another example of the crease.

Here, patterns in which a "crease" is generated will be described supplementarily. For example, as illustrated in FIGS. 9A and 9B, a crease NG may be generated in both side portions in the width direction near the trailing end of the thin sheet S2 as the medium S in the transport direction or in a region near a central portion in the width direction of the thin sheet S2. A crease may be generated in both side portions in the width direction near the leading end of the thin sheet S2 in the transport direction or in a region near a central portion of the thin sheet S2 in the width direction.

Thus, with the medium transport unit 100' according to the comparative example 1, a crease NG may be generated when the thin sheet S2 is used as the medium S. In contrast, with the medium transport unit 100 according to the first exemplary embodiment, generation of a crease NG is effectively suppressed even when the thin sheet S2 is used as the medium S.

In the present exemplary embodiment, the inclined portion 148 is disclosed as a configuration example of the outside-diameter increasing portion 147. However, the outside-diameter increasing portion 147 is not limited to this, and may be configured as in the first modification described below.

First Modification

Another configuration of the outside-diameter increasing portion 147 will be described.

Figure 4C:
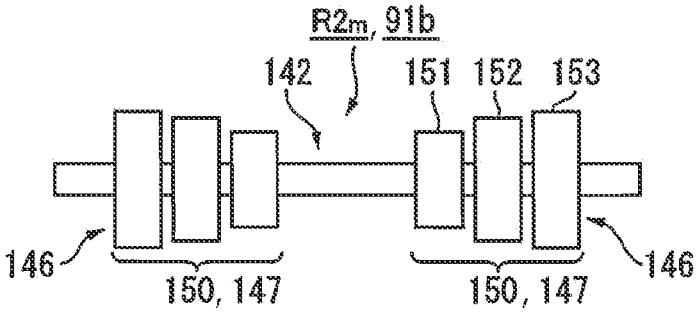
FIG. 4C illustrates another configuration example of the middle transport element.

In the present modification, for example, as illustrated in FIG. 4C, the driven roller 142 includes a pair of roller members 146 that are disposed symmetrically about the center of the rotary shaft 145 in the axial direction. As each of the roller members 146, multiple divided roller members 151 to 153, which have outside diameters that increase in a stepwise manner outward in the axial direction, are disposed. Outer peripheral portions of the multiple divided roller members 150 (151 to 153), which change in a stepwise manner, correspond to the outside-diameter increasing portion 147. Here, the differences between the outside diameters of the divided roller members 151 to 153 may be within a range that allows the outer peripheral portions of the divided roller members 151 to 153 to be arranged smoothly without gaps due to elastic deformation when the medium S is nipped in the contact region between the driving roller 141 and the driven roller 142.

In the first exemplary embodiment, the medium transport unit 100 is used in a region including the alignment roller 90. However, the medium transport unit 100 is not limited to this, and may be used as in a second modification described below.

Second Modification

For example, in the second modification, the medium transport unit 100 is used in a portion of the medium transport paths 83, 84, 87, 88, and 89 where the alignment roller 90 is not used as illustrated in FIG. 2.

In the first exemplary embodiment, the medium transport unit 100 is set in the horizontal transport path 84. However, the position of the medium transport unit 100 is not limited to this. The medium transport unit 100 may be disposed in a transport path that extends in a substantially vertical direction, such as the vertical transport path 83, the branch transport path 87, or the like. Moreover, in FIG. 2, a curved transport path 95 may be present, for example, in a portion between the vertical transport path 83 and the horizontal transport path 84. In particular, when transporting the thin sheet S2 as the medium S, a crease tends to be more easily generated in the curved transport path 95 than in a straight transport path. Therefore, in order to suppress generation of a crease, it is effective to set the medium transport unit 100 according to the present exemplary embodiment in a portion including the curved transport path 95.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A medium transport device comprising:

first transport units including a first transport unit on a front side and a first transport unit on a rear side that are respectively disposed in a front part and a rear part of a region having a length in a transport direction of a medium having a transportable minimum size and that transport the medium while nipping the medium;

a second transport unit that is disposed between the first transport units and that transports the medium while nipping the medium and pulling the nipped medium outward in a width direction intersecting the transport direction; and a controller that performs control to:

when the medium is a thin medium, cause the medium transport device to transport the medium while nipping the medium by using only the second transport unit, wherein the thin medium is a medium having a thickness less than or equal to a predetermined thickness; and when the medium is a medium other than the thin medium, cause the medium transport device to transport the medium while nipping the medium by using the first transport units and the second transport unit.

2. The medium transport device according to claim 1, wherein the second transport unit includes a driving rotor and a driven rotor that is rotated in contact with the driving rotor, the driven rotor includes a pair of roller members that are disposed symmetrically about a center in an axial direction, and an outer peripheral surface of each of the roller members is formed as an outside-diameter increasing portion whose outside diameter gradually increases outward in the axial direction.

3. The medium transport device according to claim 2, wherein the outside-diameter increasing portion is configured as an inclined portion of the outer peripheral surface of each of the roller members, the inclined portion having an outside diameter that continuously increases outward in the axial direction.

4. The medium transport device according to claim 2, wherein a surface hardness of the driving rotor of the second transport unit is lower than a surface hardness of the driven rotor of the second transport unit.

5. The medium transport device according to claim 1, wherein the second transport unit has a medium nipping pressure smaller than a medium nipping pressure of each of the first transport units.

6. The medium transport device according to claim 1, wherein each of the first transport units includes a driving rotor and a driven rotor that is rotated in contact with the driving rotor, the driving rotor and the driven rotor being capable of coming into contact with and separable from each other, and the controller separates the driving rotor and the driven rotor of each of the first transport units from each other to release a contact state when using only the second transport unit.

7. The medium transport device according to claim 6, wherein an element of the first transport units positioned on the front side also serves as an alignment transport unit that aligns a leading end position of the medium in the transport direction.

8. The medium transport device according to claim 7, wherein the second transport unit is disposed closer to the element of the first transport units positioned on the front side than to an element of the first transport units positioned on the rear side.

9. The medium transport device according to claim 7, wherein, when aligning the leading end position of the medium with the element of the first transport units positioned on the front side, the controller stops driving of the element of the first transport units positioned on the front side while maintaining a contact state and controls the element of the first transport units positioned on the rear side and the second transport unit in accordance with a thickness of the medium.

10. The medium transport device according to claim 1, comprising:

a discrimination unit that discriminates a thickness of the medium, wherein the controller controls the first transport units and the second transport unit based on a discrimination result of the discrimination unit.

11. A medium processing apparatus comprising:

the medium transport device according to claim 1; and a processing unit that performs predetermined processing on a medium transported by the medium transport device.

12. The medium processing apparatus according to claim 11, wherein the medium transport device is disposed along a medium transport path that is curved.

13. A medium transport device comprising:

first transport means on a front side and first transport means on a rear side, respectively disposed in a front part and a rear part of a region having a length in a transport direction of a medium having a transportable minimum size, for transporting the medium while nipping the medium;

second transport means, disposed between both first transport means, for transporting the medium while nipping the medium and pulling the nipped medium outward in a width direction intersecting the transport direction; and control means for performing control to:

when the medium is a thin medium, cause the medium transport device to transport the medium while nipping the medium by using only the second transport means, wherein the thin medium is a medium having a thickness less than or equal to a predetermined thickness; and when the medium is a medium other than the thin medium, cause the medium transport device to transport the medium while nipping the medium by using both first transport means and the second transport means.

* * * * *